US009856889B2

(12) United States Patent
Wilie

(10) Patent No.: US 9,856,889 B2
(45) Date of Patent: Jan. 2, 2018

(54) PROPELLANT DRIVEN ACCUMULATOR

(71) Applicant: SHELL OIL COMPANY, Houston, TX (US)

(72) Inventor: Curtis Len Wilie, Friendswood, TX (US)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 14/895,587

(22) PCT Filed: Jun. 4, 2014

(86) PCT No.: PCT/US2014/040853
§ 371 (c)(1),
(2) Date: Dec. 3, 2015

(87) PCT Pub. No.: WO2014/197560
PCT Pub. Date: Dec. 11, 2014

(65) Prior Publication Data

US 2016/0108934 A1 Apr. 21, 2016

Related U.S. Application Data

(60) Provisional application No. 61/831,900, filed on Jun. 6, 2013.

(51) Int. Cl.

| | |
|---|---|
| ***F15B 1/04*** | (2006.01) |
| ***E21B 33/064*** | (2006.01) |
| ***E21B 33/035*** | (2006.01) |
| *E21B 41/04* | (2006.01) |
| *C06D 5/00* | (2006.01) |
| *F15B 1/08* | (2006.01) |
| *E21B 41/00* | (2006.01) |

(52) U.S. Cl.
CPC ..... *F15B 1/04* (2013.01); *E21B 33/0355* (2013.01); *E21B 33/064* (2013.01)

(58) Field of Classification Search
None
See application file for complete search history.

(56) References Cited

U.S. PATENT DOCUMENTS

| | | | | |
|---|---|---|---|---|
| 5,647,734 | A | 7/1997 | Milleron | |
| 9,212,103 | B2 * | 12/2015 | Coppedge | C06D 5/00 |
| 2004/0089450 | A1 | 5/2004 | Slade et al. | |
| 2010/0012327 | A1 | 1/2010 | Leonardi et al. | |
| 2012/0305258 | A1 | 12/2012 | Baugh | |

* cited by examiner

*Primary Examiner* — Matthew R Buck
*Assistant Examiner* — Douglas S Wood

(57) ABSTRACT

A subsea accumulator comprising: an outer wall; a top surface; a bottom surface; and a piston disposed within the subsea accumulator, wherein a first chamber is defined by the top surface, the outer wall, and a top portion of the piston; a second chamber is defined by the bottom surface; the outer wall, and a bottom portion of the piston; and a solid oxidant is disposed within the first chamber.

16 Claims, 2 Drawing Sheets

PROPELLANT DRIVEN ACCUMULATOR

CROSS REFERENCE TO RELATED APPLICATIONS

This application claims the benefit of U.S. Provisional Application No. 61/831,900, filed Jun. 6, 2013, which is incorporated herein by reference.

BACKGROUND

The present disclosure relates generally to subsea accumulators. More specifically, in certain embodiments the present disclosure relates to subsea accumulators comprising slow burning fuses and associated methods.

Considerable safety measures are required when drilling for oil and gas on-shore and off-shore. One such safety measure is the use of blowout preventers (BOPs). BOPs are basically large valves that close, isolate, and seal the wellbore to prevent the discharge of pressurized oil and gas from the well during a kick or other event. One type of BOP used extensively is a ram-type BOP. This type of BOP uses two opposing rams that close by moving together to either close around the pipe or to cut through the pipe and seal the wellbore.

The blowout preventers are typically operated using pressurized hydraulic fluid to control the position of the rams. Most BOPs are coupled to a fluid pump or another source of pressurized hydraulic fluid. In most applications, multiple BOPs are combined to form a BOP stack, and this may include the use of multiple types of BOPs. In some applications, several hundred gallons of pressurized hydraulic fluid may have to be stored in bottles at the BOP to be able to operate the BOP.

BOPs may be actuated by an accumulator. Traditional accumulators use a gas as a 'spring' to provide fluid storage at pressure. When these devices are taken subsea, the gas spring may need to be pre-charged to high pressures. This may result in very low efficiencies as the gas becomes less compressible at greater depths. A typical deepwater gas accumulator may provide only ½ gallon of "useable" fluid from an 11+ gallon accumulator. At extreme depths even greater challenges emerge as the gas becomes effectively incompressible and no longer acts as a good spring. This may require deepwater BOPs to carry more and more accumulators to achieve the necessary stored volume, creating very significant size and weight issues. A modern, deepwater BOP stack can require more than 100 accumulators in order to provide sufficient useable fluid volume.

It is desirable to develop an actuator for a blowout preventer that does not suffer from the same drawbacks of conventional actuators.

SUMMARY

The present disclosure relates generally to subsea accumulators. More specifically, in certain embodiments the present disclosure relates to subsea accumulators comprising slow burning fuses and associated methods.

In one embodiment, the present disclosure provides a subsea accumulator comprising: an outer wall; a top surface; a bottom surface; and a piston disposed within the subsea accumulator, wherein a first chamber is defined by the top surface, the outer wall, and a top portion of the piston; a second chamber is defined by the bottom surface; the outer wall, and a bottom portion of the piston; and a solid oxidant is disposed within the first chamber.

In another embodiment, the present disclosure provides a blowout preventer system comprising: a blowout preventer and subsea accumulator, wherein the subsea accumulator comprises: an outer wall; a top surface; a bottom surface; and a piston disposed within the subsea accumulator, wherein a first chamber is defined by the top surface, the outer wall, and a top portion of the piston; a second chamber is defined by the bottom surface; the outer wall, and a bottom portion of the piston; and a solid oxidant is disposed within the first chamber.

In another embodiment, the present disclosure provides a method of actuating a blowout preventer comprising: providing a blow out preventer providing a subsea accumulator, wherein the subsea accumulator comprises: an outer wall; a top surface; a bottom surface; and a piston disposed within the subsea accumulator, wherein a first chamber is defined by the top surface, the outer wall, and a top portion of the piston; a second chamber is defined by the bottom surface; the outer wall, and a bottom portion of the piston; and a solid oxidant is disposed within the first chamber; connecting the subsea accumulator to the blowout preventer via a work line, wherein the work line comprises an actuating valve; and opening the actuating valve to actuate the blowout preventer.

BRIEF DESCRIPTION OF THE DRAWINGS

A more complete and thorough understanding of the present embodiments and advantages thereof may be acquired by referring to the following description taken in conjunction with the accompanying drawings.

The features and advantages of the present disclosure will be readily apparent to those skilled in the art. While numerous changes may be made by those skilled in the art, such changes are within the spirit of the disclosure.

DETAILED DESCRIPTION

The description that follows includes exemplary apparatuses, methods, techniques, and instruction sequences that embody techniques of the inventive subject matter. However, it is understood that the described embodiments may be practiced without these specific details.

The present disclosure relates generally to subsea accumulators. More specifically, in certain embodiments the present disclosure relates to subsea accumulators comprising slow burning fuses and associated methods.

One potential advantage of the accumulators discussed herein is that they may be capable of producing a large volume while only having a small footprint. In certain embodiments, a single accumulator may be sufficient to operate an entire subsea blowout preventer system. Another potential advantage of the accumulators discussed herein is that they may be self charging.

Figure 1:
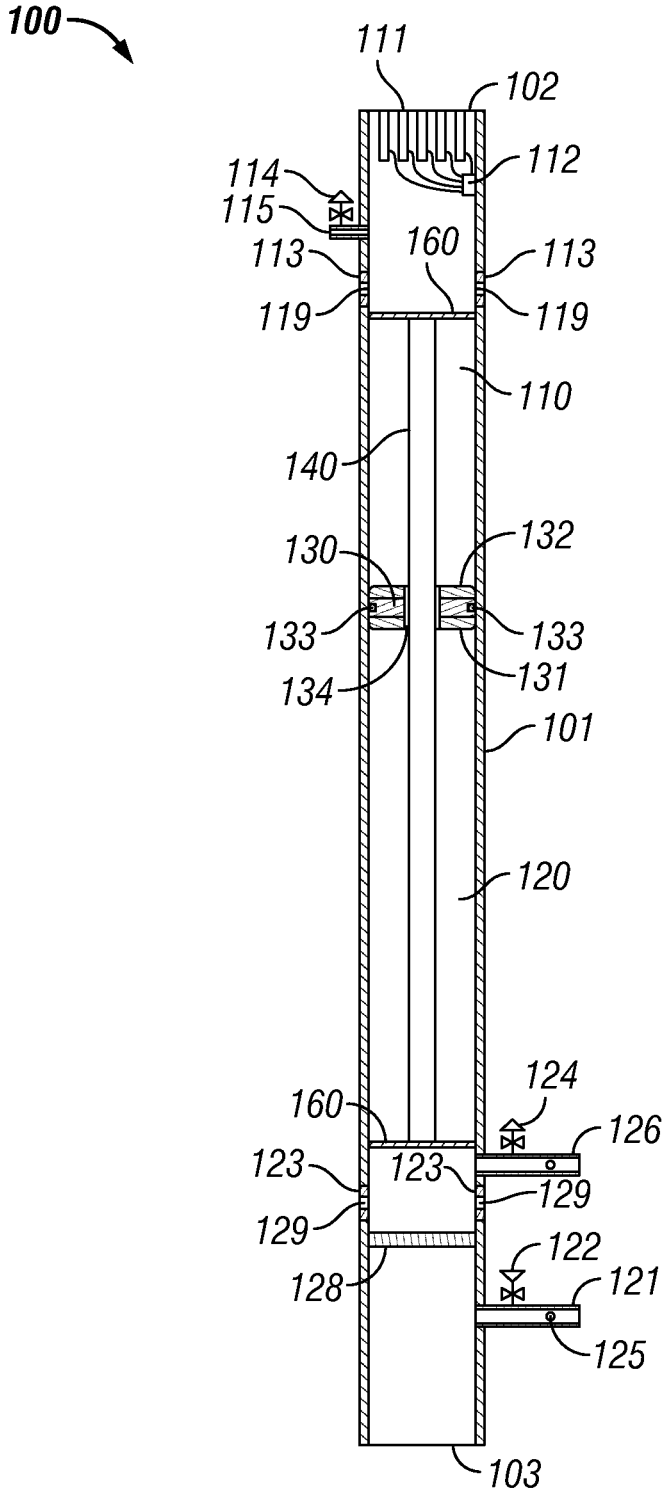
FIG. 1 illustrates a subsea accumulator in accordance with certain embodiments of the present disclosure.

Referring now to FIG. 1, FIG. 1 illustrates a subsea accumulator 100 in accordance with certain embodiments of the present disclosure. In certain embodiments, subsea accumulator 100 may be cylindrically shaped. In certain embodiments, subsea accumulator 100 may comprise a housing constructed out of any material suitable that can resist both internal pressure and the hydrostatic pressure of a body of water at the depth at which the subsea accumulator may be disposed during use. Examples of suitable materials include stainless steel, titanium, or other high strength materials that can resist both internal pressure and the hydrostatic pressure of a body of water at the depth at which the subsea accumulator may be disposed during use. In certain embodiments, subsea accumulator 100 may comprise a 15 ksi housing.

Subsea accumulator 100 may comprise outer wall 101, top surface 102, bottom surface 103, first chamber 110, second chamber 120, piston 130, and mandrel 140.

In certain embodiments, first chamber 110 may be a gas chamber. In certain embodiments, first chamber 110 may have a volume of from about 10 gallons to about 100 gallons. In certain embodiments, the operating pressure in first chamber 110 may be in the range from atmospheric pressure to 15,000 psi. In certain embodiments, a pressure of about 8,500 psi may be maintained in the first chamber 110. In certain embodiments, first chamber 110 may be defined as the internal volume of subsea accumulator 100 above piston 130 and below top surface 102. In certain embodiments, first chamber 110 may be a sealed chamber. In certain embodiments, a solid oxidant 111 and an ignition system 112 may be disposed within first chamber 111.

In certain embodiments, solid oxidant 111 may comprise any solid oxidant capable of generating gas when ignited. Suitable examples of solid oxidants include propellants. An example of a suitable propellant is MK90 propellant manufactured by Alliant Techsystems. In certain embodiments, solid oxidant 111 may comprise one or more rods.

In certain embodiments, ignition system 112 may comprise any ignition system that can be remotely activated to ignite the solid oxidant 111. In certain embodiments, ignition system 112 may be capable of igniting the solid oxidant 111 automatically. In certain embodiments, ignition system 112 may be capable of igniting solid oxidant 111 one rod at a time.

In certain embodiments, first chamber 110 may further comprise a filler sub 113. In certain embodiments, filler sub 113 may comprise one or more ports 119 that can facilitate the filling of first chamber 110 with gas. In certain embodiments, first chamber 110 may further comprise a relief valve 114 and a relief line 115.

In certain embodiments, second chamber 120 may be a hydraulic chamber. In certain embodiments, second chamber 120 may be filled with hydraulic fluid. In other embodiments, second chamber 120 may be filled with seawater. In certain embodiments, the operating pressure of second chamber 120 may range from atmospheric pressure to 15,000 psi. In certain embodiments, a pressure of about 10,000 psi may be maintained in the second chamber 120. In certain embodiments, the volume of second chamber 120 may be in the range of from 50 gallons to 500 gallons.

In certain embodiments, second chamber 120 may be defined as the internal volume of the subsea accumulator 100 above bottom surface 103 and below piston 130. In certain embodiment second chamber 120 may comprise a discharge line 121.

Discharge line 121 may include discharge valve 122 and may be used to provide hydraulic pressure from second chamber 120 to the rams of a blowout preventer. Discharge valve 122 may be any type of valve commonly used in the art. In certain embodiments, discharge line 121 may include fluid sensor 125 capable of sensing flow of hydraulic fluid through discharge line 121.

In certain embodiments, second chamber 110 may further comprise a filler sub 123. In certain embodiments, filler sub 123 may comprise one or more ports 129 that can facilitate the filling of second chamber 120 with seawater or hydraulic fluid. In certain embodiments, second chamber 120 may further comprise a relief valve 124, a relief line 126, and a filter 128.

In certain embodiments, piston 130 may comprise a floating piston. In certain embodiments, piston 130 may have a top bottom portion 131, a top portion 132, and one or more seals 133. Piston 130 may be constructed out of any suitable material. In certain embodiments, piston 130 may be constructed of steel. In certain embodiments, piston 130 may further comprise a cavity 134. In certain embodiments, piston 130 may be disposed around mandrel 140. In certain embodiments, piston 130 may be capable of sealing first chamber 110 from second chamber 120.

In certain embodiments, mandrel 140 may be a solid support mandrel disposed within the internal cavity of subsea accumulator 100. In certain embodiments, mandrel 140 may be comprised of steel.

Piston 130 may capable of moving up and down within subsea accumulator 100 depending on the pressure and volume changes within first chamber 110 and second chamber 120. For example, when the pressure in first chamber 110 is increased, for example by the generation of gas from the ignition of solid oxidant 111, piston 130 may move downward compressing the hydraulic fluid in second chamber 120 such that the pressure in first chamber 110 is the same as the pressure in second chamber 120. Furthermore, when the pressure in second chamber 120 is decreased, for example when discharge valve 122 is opened to provide flow in discharge line 121, piston 130 may move downward compressing the remaining hydraulic fluid in second chamber 120 such that the pressure in first chamber 110 is the same as the pressure in second chamber 120. In certain embodiments, piston 130 may be capable of moving up and down mandrel 140. In certain embodiments, subsea accumulator 100 may further comprise one or more piston stops 160 disposed in first chamber 110 and/or second chamber 120.

Figure 2:
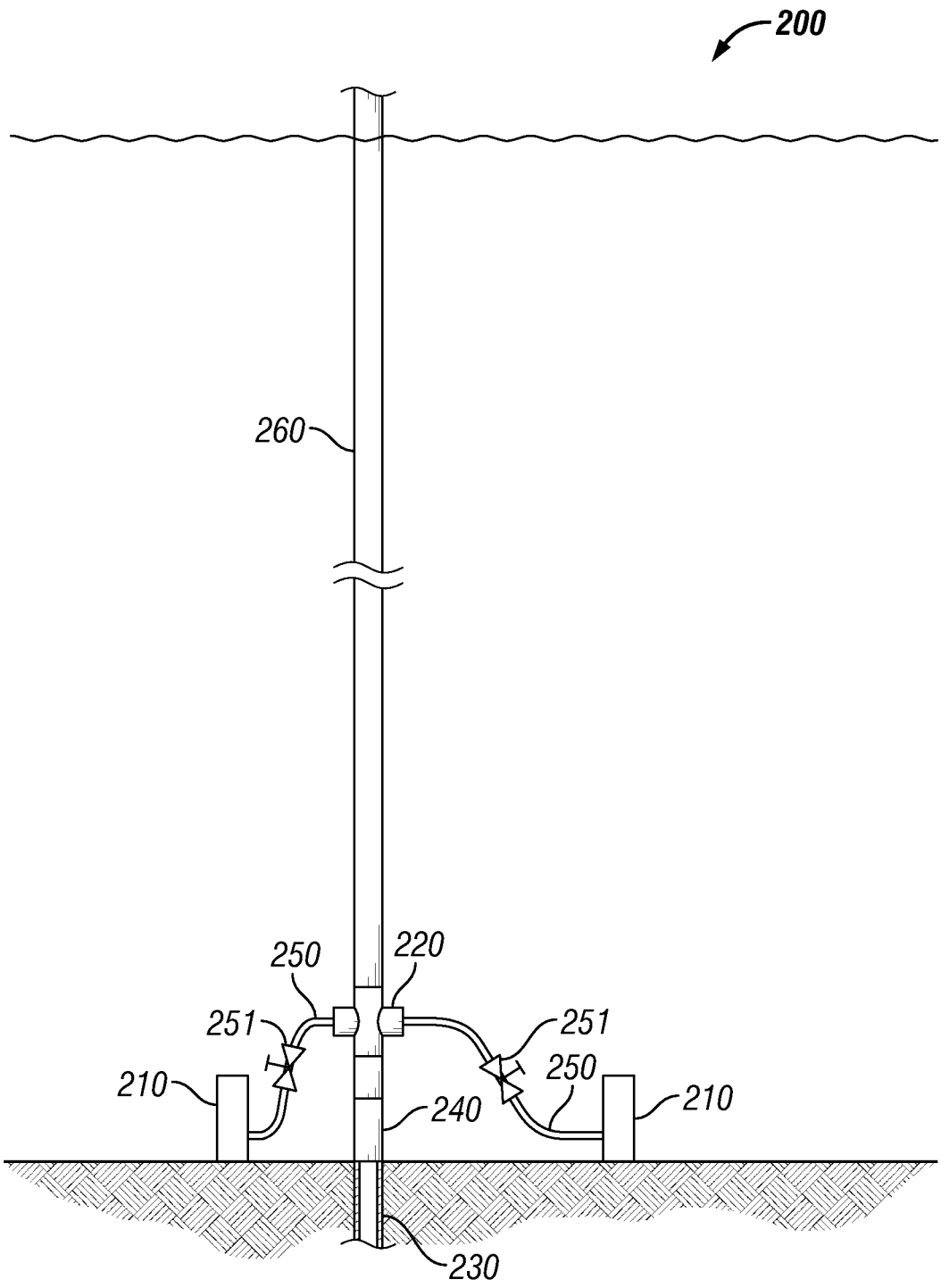
FIG. 2 illustrates a subsea blowout preventer system in accordance to certain embodiments of the present disclosure.

Referring now to FIG. 2, FIG. 2 illustrates a blowout preventer system 200 in accordance with certain embodiments of the present disclosure. As can be seen in FIG. 2, blowout preventer system 200 may comprise subsea accumulator 210, blowout preventer 220, well 230, well head 240, work line 250 comprising actuating valve 251, and riser 260. Subsea accumulator 210 may have the same features discussed above with respect of subsea accumulator 100.

In certain embodiments, blowout preventer 220 may comprise a single blowout preventer or multiple blowout preventers arranged in a stack. In certain embodiments, blowout preventer 220 may be attached to a wellhead 240 on top of well 230.

In certain embodiments, blowout preventer 220 may be connected to subsea accumulators 210 through work lines 250. In certain embodiments, work line 250 may be connected to the hydraulic chamber of subsea accumulator 210 and rams of blowout preventer 220. In such embodiments, hydraulic pressure would actuate blowout preventer 220 when actuating valve 251 of work line 250 is opened.

In certain embodiments, the present disclosure provides a method of actuating a blowout preventer comprising: providing a blowout preventer; providing a subsea accumulator; connecting the subsea accumulator to the blowout preventer via a work line, wherein the work line comprises an actuating valve; and opening the actuating valve.

In certain embodiments, the subsea accumulator may be provided by lowering the subsea accumulator into the subsea environments. Once lowered into the subsea environment, the subsea accumulator may be connected to the blowout preventer via a work line. In certain embodiments, the work line is connected to the hydraulic chamber of the subsea accumulator and the rams of the blowout preventer.

In certain embodiments, the subsea accumulator may be charged before or after it is lowered into the subsea environment and/or before or after it is connected to the blowout preventer. For example, in certain embodiments, the subsea accumulator may be charged in the subsea environment by igniting a first portion of the solid oxidant to produce a first quantity of gas in the first chamber. The production of the first quantify of gas will increase the pressure within the first chamber, causing the piston to move downward compressing the hydraulic fluid in the second chamber. In other embodiments, the subsea accumulator may be charged before it is lowered into the subsea environment.

Once the subsea accumulator is charged and connected to the blowout preventer, actuator valves on the work lines may be opened to actuate the ram. After the blowout preventer has been actuated, the subsea accumulator may be recharged by closing the actuator valve on the work line and igniting a second quantity of solid oxidant in the first chamber, thus re-pressurizing the hydraulic fluid in the hydraulic chamber.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

The invention claimed is:

1. A subsea accumulator comprising: an outer wall; a top surface; a bottom surface; and a piston disposed within the subsea accumulator, wherein a first chamber is defined by the top surface, the outer wall, and a top portion of the piston;

a second chamber is defined by the bottom surface; the outer wall, and a bottom portion of the piston; and a solid oxidant is disposed within the first chamber, wherein the solid oxidant comprises a first portion of solid oxidant and a second portion of solid oxidant and wherein the subsea accumulator is capable of being charged by igniting the first portion of the solid oxidant and is capable of being recharged by igniting the second portion of the solid oxidant.

2. The subsea accumulator of claim 1, further comprising an ignition system disposed within the first chamber.

3. The subsea accumulator of claim 1, wherein the solid oxidant comprises one or more rods and the ignition system is capable of igniting the solid oxidant one rod at a time.

4. The subsea accumulator of claim 1, wherein the solid oxidant comprises a propellant.

5. The subsea accumulator of claim 1, wherein the second chamber is filled with a hydraulic fluid.

6. The subsea accumulator of claim 1, wherein the second chamber is filled with sea water.

7. The subsea accumulator of claim 1, further comprising a discharge line connected to the second chamber.

8. The subsea accumulator of claim 1, wherein the piston is disposed around a mandrel.

9. The subsea accumulator of claim 1, wherein the piston is disposed around a mandrel.

10. A blowout preventer system comprising:

a blowout preventer and subsea accumulator, wherein the subsea accumulator comprises: an outer wall; a top surface; a bottom surface; and a piston disposed within the subsea accumulator, wherein a first chamber is defined by the top surface, the outer wall, and a top portion of the piston;

a second chamber is defined by the bottom surface; the outer wall, and a bottom portion of the piston; and a solid oxidant is disposed within the first chamber, wherein the solid oxidant comprises a first portion of solid oxidant and a second portion of solid oxidant and wherein the subsea accumulator is capable of being charged by igniting the first portion of the solid oxidant and is capable of being recharged by igniting the second portion of the solid oxidant.

11. The blowout preventer system of claim 10, wherein the subsea accumulator further comprises an ignition system disposed within the first chamber.

12. The blowout preventer system of claim 10, wherein the solid oxidant comprises one or more rods and the ignition system is capable of igniting the solid oxidant one rod at a time.

13. The blowout preventer system of claim 10, wherein the solid oxidant comprises a propellant.

14. The blowout preventer system of claim 10, wherein the second chamber is filled with a hydraulic fluid.

15. The blowout preventer system of claim 10, wherein the second chamber is filled with sea water.

16. The blowout preventer system of claim 10, wherein the subsea accumulator further comprises a discharge line forming a fluid connection between the second chamber of the subsea accumulator and the blowout preventer.

* * * * *